United States Patent [19]

Suda

[11] 3,973,544

[45] Aug. 10, 1976

[54] IGNITION SYSTEM FOR INTERNAL COMBUSTION ENGINES

[75] Inventor: Seiji Suda, Mito, Japan

[73] Assignee: Hitachi, Ltd., Japan

[22] Filed: Aug. 21, 1973

[21] Appl. No.: 390,305

[30] Foreign Application Priority Data

Aug. 23, 1972 Japan ..... 47-83755

[52] U.S. Cl. ..... 123/148 CB; 315/209 CD

[51] Int. Cl.[2] ..... F02P 1/00

[58] Field of Search .. 123/148 E, 148 OC, 148 MC, 123/148 IC; 315/209 CD

[56] References Cited

UNITED STATES PATENTS

| | | | |
|---|---|---|---|
| 3,306,275 | 2/1967 | Hufton | 123/148 E |
| 3,489,129 | 1/1970 | Issler | 123/148 OC |
| 3,714,507 | 1/1973 | Schweitzer | 123/148 OC |
| 3,741,183 | 6/1973 | Strum | 123/148 OC |
| 3,791,364 | 2/1974 | Saita | 123/148 E |

FOREIGN PATENTS OR APPLICATIONS

| | | | |
|---|---|---|---|
| 931,894 | 7/1963 | United Kingdom | 123/148 E |

*Primary Examiner*—Charles J. Myhre
*Assistant Examiner*—Ronald B. Cox
*Attorney, Agent, or Firm*—Craig & Antonelli

[57] ABSTRACT

An ignition system for internal combustion engines, in which a spark is produced across a spark plug gap when a capacitor is discharged through a primary winding of an ignition coil.

As a switching means for energizing and deenergizing the primary winding of the ignition coil a transistor is used, and also a time constant circuit for controlling the transistor is provided. At the time of producing a spark by rendering the transistor conductive, electromagnetic energy is stored in the primary winding of the ignition coil. When the transistor is subsequently cut off by the action of the afore-mentioned time constant circuit, a second spark is produced with the electromagnetic energy stored in the primary winding.

31 Claims, 5 Drawing Figures

IGNITION SYSTEM FOR INTERNAL COMBUSTION ENGINES

BACKGROUND OF THE INVENTION

1. Field of the Invention

This invention relates to an ignition system for internal combustion engines for vehicles.

2. Description of the Prior Art

In view of the recent problem of air contamination, it is very important to reduce the content of harmful components in the automotive exhaust gas for reducing the contamination. To give a solution to this problem methods of recirculating part of the exhaust gas from the internal combustion engine to the intake system thereof have been investigated. Also, it is a recent trend to use lead-free gasoline incorporating high-molecular compounds in place of lead in order to extent the service life of the catalyst used for purifying the exhaust gas.

It will be seen from the above that with the progress of the measures against the exhaust gas the condition for the combustion of the air-fuel mixture in the engine cylinder becomes severer, that is, increased energy and prolonged spark duration are required for bringing about the ignition. Also, where high-molecular compounds are incorporated in the fuel and where the exhaust gas is recirculated, the spark plug is more likely to be contaminated with carbon and other deposits. These deposits form shunt resistance between the discharge points of the spark plug, thus reducing the voltage applied across the spark plug gap.

Accordingly, the ignition system is required to meet the following:

1. It has to be superior in its ability to withstand contamination.
2. It must have a superior combustion ability.
3. The spark duration should be long.

As a further basic requirement for the ignition system, it is desired to be able to take out a constant spark energy irrespective of the engine speed. With a usual transistor type ignition system the energy stored in the primary winding of the ignition coil varies to vary the spark energy with the engine speed.

Still further, a spark of great energy is desired in the initial stage of the spark discharge. This is because a great spark energy is required for the ignition of the air-fuel mixture where the ratio of fuel to air is large.

Heretofore, no ignition system meeting all of the above requirements has existed.

In a typical prior-art ignition system, a predetermined current carried by the primary winding of the ignition coil is cut off in accordance with the ignition timing, thereby bringing about the discharge in the spark plug gap due to the energy stored in the primary winding. The cutting off the primary winding current is usually effected by means of a transistor or a mechanical switch. (This system is hereinafter referred to as a transistor type ignition system). In another system, a capacitor is charged with a stepped-up high voltage and is discharged through the primary winding of the ignition coil in accordance with the ignition timing. In this case, the discharge of the capacitor through the primary winding is effected through a thyristor. (This system is hereinafter referred to as a thyristor type ignition system.)

As mentioned above, in a transistor type ignition system the engine speed versus spark energy characteristic is inferior, that is, the spark energy varies greatly with the engine speed. Also, since the primary side of the ignition coil is opened when the spark is produced, the effect of the resistance of the secondary side of the ignition coil and the energy loss due to the contamination of the spark plugs are great.

In a thyristor type ignition system, the primary side of the ignition coil is short-circuited at the time of generation of a spark, so that this system is less affected by the contamination of the spark plugs. Also, since the energy stored in the capacitor is supplied to the primary winding of the ignition coil in a short time, a very large energy can be obtained momentarily. However, in this system the spark duration is very short. Therefore, it is very difficult to ensure ignition where the proportion of fuel is very small.

Accordingly, there is a need for an ignition system, in which the above drawbacks inherent in the prior-art ignition systems are minimized.

SUMMARY OF THE INVENTION

An object of the present invention is to provide an ignition system for internal combustion engines, which is superior in its ability to withstand contamination.

Another object of the invention is to provide an ignition system for internal combustion engines, which has a superior combustion ability and permits to obtain a long spark duration.

To achieve the above-mentioned objects, the ignition system for internal combustion engines according to the invention has a capacitor, which is charged with a voltage obtained by stepping up a source voltage. In this system, a first spark is produced in the spark plug gap when the capacitor is discharged through the primary winding of an ignition coil, and upon subsequent shutting of the discharging current off from the primary winding a second spark is produced due to the electromagnetic energy stored in the primary winding.

The first spark has a great momentary spark energy since the charge stored in the capacitor flows into the primary winding of the ignition coil. Also, since the primary winding is short-circuited when this spark is produced, this system is very superior in its ability to withstand contamination. Further, since a current is caused through the primary winding at the time of the ignition, the spark energy will hardly vary with changing engine speed.

The second spark, which is produced due to the electromagnetic energy stored in the primary winding at the time when the current is cut off therefrom, is sustained for a long time.

It will be seen from the above that the ignition system according to the invention has very ideal performance.

The capacitor used in the ignition system according to the invention for storing the stepped-up voltage and being discharged through the primary winding of the ignition coil may be omitted if a high voltage source is capable of always supplying a high voltage. However, the method of temporarily storing the stepped-up voltage across the capacitor and discharging it through the primary winding of the ignition coil is very desired since an inexpensive and small-size ignition system is preferred for use in vehicles.

The above and other objects, features and advantages of the invention will become more apparent from the following description having reference to the accompanying drawings.

DETAILED DESCRIPTION OF THE PREFERRED EMBODIMENT

Figure 1:
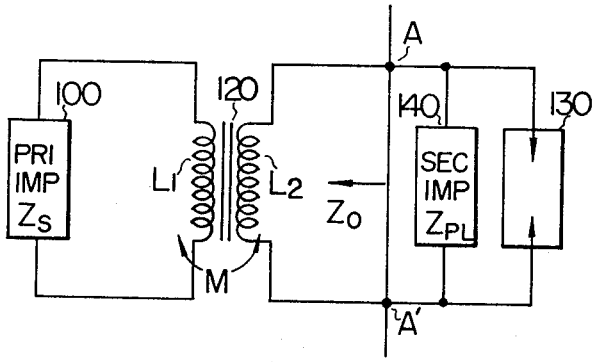
FIG. 1 is a schematic showing an ignition circuit.

FIG. 1 outlines an ignition system. Referring to the figure, numeral 120 designates an ignition coil with primary winding $L_1$ and secondary winding $L_2$. Numeral 100 designates the primary side impedance connected across the primary winding $L_1$. Actually, the primary winding of the ignition coil is connected across a d-c power supply through switching means, and the impedance 100 represent an equivalent impedance $Z_s$ of the circuit consisting of the d-c power supply, the switching means and the primary winding of the ignition coil. Here, the primary winding $L_1$ can be regarded to be an ideal coil.

The secondary winding $L_2$ of the ignition coil 120 is connected to a spark plug 130. Between the terminals of the secondary winding $L_2$ there is a leakage circuit formed due to the contamination. The resistance of this leakage circuit and the resistance of the secondary winding $L_2$ are represented by an equivalent impedance 140. Accordingly, the secondary winding $L_2$ here can be regarded as an ideal coil. Then the equivalent impedance $Z_0$ of the circuit on the ignition coil side viewing from the points A–A′ in FIG. 1 is given as $$Z_0 = j\omega L_2 + \frac{\omega^2 M^2}{j\omega L_1 + Z_s} \qquad (1)$$

where M is the mutual inductance of the primary and secondary coils $L_1$ and $L_2$ of the ignition coil 120, and $\omega$ is the angular velocity of oscillation of the current caused in the primary winding $L_1$ by the switching means connected thereto.

Figure 2:
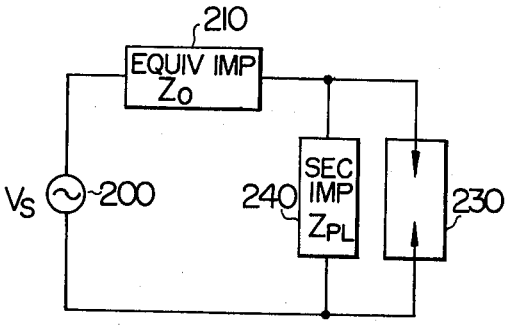
FIG. 2 shows an equivalent circuit to the ignition circuit of FIG. 1.

The circuit of FIG. 1 may be replaced with a simplified equivalent circuit by using this equivalent impedance $Z_O$ as shown in FIG. 2. More particularly, denoting the impedance of the circuit on the power supply side viewing from the points A–A′ by $Z_O$ and the electromotive force induced in the secondary winding of the ignition coil by $V_s$, the afore-mentioned power supply side circuit is equivalent to a series circuit of an a-c source 200 with electromotive force $V_s$ and a load 210 of impedance $Z_O$.

In the equivalent circuit of FIG. 2, therefore, the internal impedance load 210 of impedance $Z_O$ and a-c source 200 of electromotive force $V_s$ are connected across the parallel circuit of load 240 of impedance $Z_{PL}$ and spark plugs 230.

Denoting the voltage appearing across the spark plug gap by $V_{PL}$, $$V_{PL} = \frac{Z_{PL}}{Z_0 + Z_{PL}} \cdot V_s \qquad (2)$$

If $Z_O$ is large, this voltage $V_{PL}$ is small. The impedance $Z_O$ is thus very important, and it will now be considered in detail.

In equation (1) for $Z_O$, $L_1$, $L_2$ and M are constants determined by the design of the ignition coil. Thus, the impedance $Z_O$ depends upon the equivalent impedance $Z_s$ of the load such as switching means and d-c power supply connected to the primary winding of the ignition coil. This means that the impedance $Z_O$ depends upon the type of the ignition system.

As mentioned above, there are two types of ignition systems, namely one where a flowing current is cut off at the time of ignition, and one where a current is caused at the time of ignition. The former system is called a transistor type, and the latter is called a capacitor discharge type or thyristor type.

In the system where a current is cut off at the time of ignition, $Z_s$ can be regarded to be infinite. Then, from equation (1)

$$Z_O = j\omega L_2$$

Hence, from equation (2)

$$V_{PL} = \frac{Z_{PL}}{j\omega L_2 + Z_{PL}} \cdot V_s \qquad (3)$$

In the system where a current is caused at the time of ignition, $Z_s$ is very small and can be regarded to be zero. Then, $$Z_O = j\omega L_2 (1 - K^2), \qquad 4.$$

where $K = M/ \quad L_1 . L_2$ .

Hence, the voltage $V_{PL}$ appearing across the spark plug gap is $$V_{PL} = \frac{Z_{PL}}{j\omega L_2(1-K^2) + Z_{PL}} \cdot V_s \qquad (5)$$

Comparing equations (3) and (5), it will be seen that the voltage $V_{PL}$ represented by equation (5) is greater than that given by equation (3). The above analysis are very rough in some aspects, but it expressly shows that the system where a current is caused for producing a spark is superior in the ability to withstand the contamination. This system of causing a spark through electric conduction, however, usually has a drawback in that the duration of the spark is short.

Figure 3:
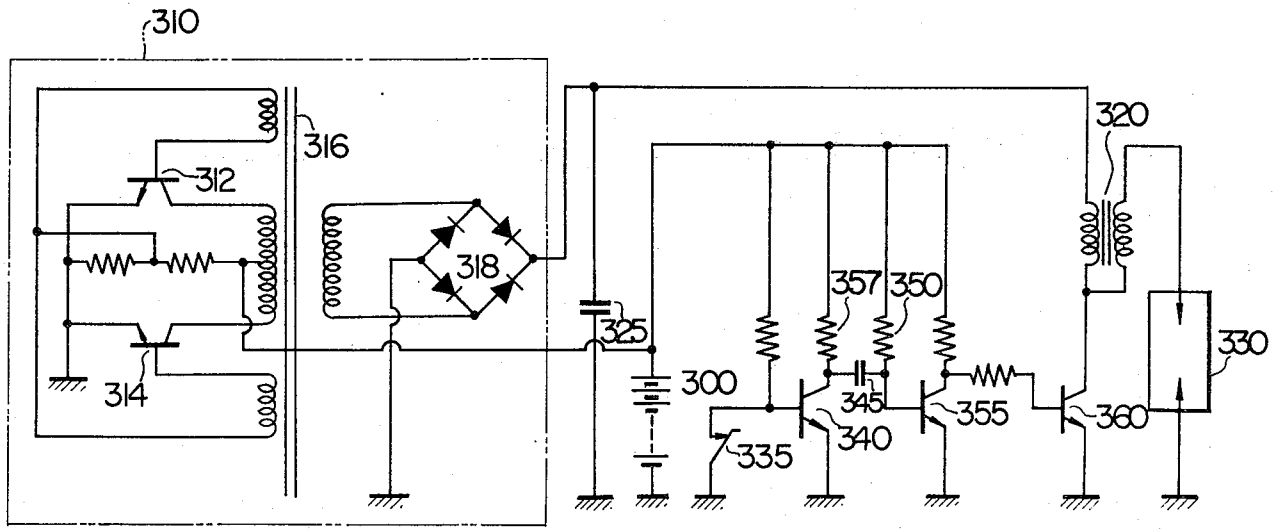
FIG. 3 is a circuit diagram showing an embodiment of the invention.

FIG. 3 shows an embodiment of the invention, which can overcome the above drawback. Referring to the figure, a voltage step-up circuit 310 steps up the voltage of a battery 300 for storage across a capacitor 325. The voltage step-up circuit 310 comprises transistors 312 and 314, a step-up transformer 316 and a rectifying circuit 318. The transistors 312 and 314 and the primary winding of the step-up transformer 316 constitute an oscillator. A stepped-up voltage is induced in the secondary of the step-up transformer 316 and is rectified through the rectifying circuit 318 for storage across the capacitor 325.

Numeral 320 designates an ignition coil. Its primary winding is connected in series with the capacitor 325 and a transistor 360, and its secondary winding is connected to a spark plug 330. A breaker 335 opens at instants when ignition is to be caused in synchronizm to the engine crankshaft. Numerals 340, 355 and 360 designate transistors.

When the breaker 335 opens at the time when ignition is to be caused, the transistor 340 is triggered, thus grounding the base of the transistor 355 through a capacitor 345 and the transistor 340 to cut off the transistor 355. As a result, the base voltage of the transistor 360 is increased to trigger the transistor 360.

Upon triggering of the transistor 360, the capacitor 325 is discharged through the primary winding of the ignition coil 320. The voltage developed at this time across the primary winding of the ignition coil is about 250 to 300 volts, and a voltage of about 25 to 30 kilovolts determined by the turn ratio of the primary winding to the second winding, is induced in the secondary winding. This voltage produces a spark across the spark plug gap. With a current flowing in the primary winding of the ignition coil at the time of the discharging of the capacitor 325 an electromagnetic energy is stored in the primary winding.

Meanwhile, upon turning-on of the transistor 340 the capacitor 345 connected between the collector of the transistor 340 and the base of the transistor 355 begins to be charged with a current flowing into it through a resistor 350, and after the lapse of a predetermined time the transistor 355 is triggered to be conductive and thus cut off the transistor 360. As a result, the electromagnetic energy stored in the primary winding of the ignition coil now causes a voltage to be developed in the secondary winding, so that the spark in the spark plug gap is prolonged.

Figure 4:
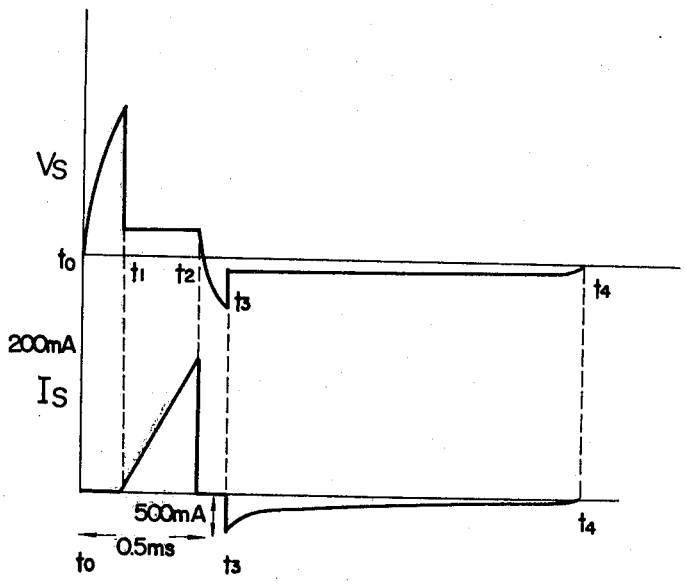
FIG. 4 is a waveform chart showing the voltage across the spark plug gap and the spark current in the ignition system according to the invention.

FIG. 4 shows the waveforms of the voltage impressed across the spark plug gap and the spark current.

It is assumed that at instant $t_0$ the breaker 335 opens to trigger the transistor 360. From this instant, the spark gap voltage $V_s$ sharply builds up, and at instant $t_1$ the insulation is broken down, causing a spark, that is, causing the spark current $I_s$. When the spark current is caused to flow, the spark plug gap voltage is reduced down to and settles at a predetermined level.

After a predetermined time determined by the time constant of the circuit consisting of the resistor 350 and capacitor 345 the transistor 360 is cut off at instant $t_2$, whereupon an opposite polarity voltage is developed across the spark plug gap due to the electromagnetic energy stored in the primary winding of the ignition coil. As this opposite polarity voltage builds up, the insulation is broken again at instant $t_3$, thus causing a spark again. This resumed spark is sustained for a long time, and it disappears at instant $t_4$.

As is apparent from the waveform chart of FIG. 4, the voltage $V_s$ rises quickly. Also, the level of the spark current is high; in experiments it reached as high as about 200 milliamperes. The time interval from $t_0$ to $t_4$ was 1 to 2 milliseconds.

In this system, the first spark is produced by triggering the transistor 360 to be conductive. Thus, this system can strongly withstand the contamination. Further, the second spark is produced with the energy stored in the primary winding by cutting off the transistor 360 after the lapse of a predetermined time. Thus, the duration of the spark can be prolonged.

The time from the triggering until the cutting-off of the transistor 360 is determined by the time constant of the circuit of resistor 350 and capacitor 345. By setting this time to about 0.5 milliseconds, a spark duration of about 1 to 2 milliseconds could be obtained.

When the transistor 340 is cut off, the capacitor 345 is discharged through the resistors 350 and 357. The breaker 335 may be of any type according to the invention, although mechanical ones have usually been employed. The transistor 340 may be cut off to be ready for repeating the above sequence of operation with any ignition timing signal obtained by a breaker of any type.

It is an important feature of the invention to produce a first spark by rendering the primary winding of the ignition coil into conduction state and, then produce a subsequent second spark with the electromagnetic energy stored in the primary winding at the time of producing the first spark.

Figure 5:
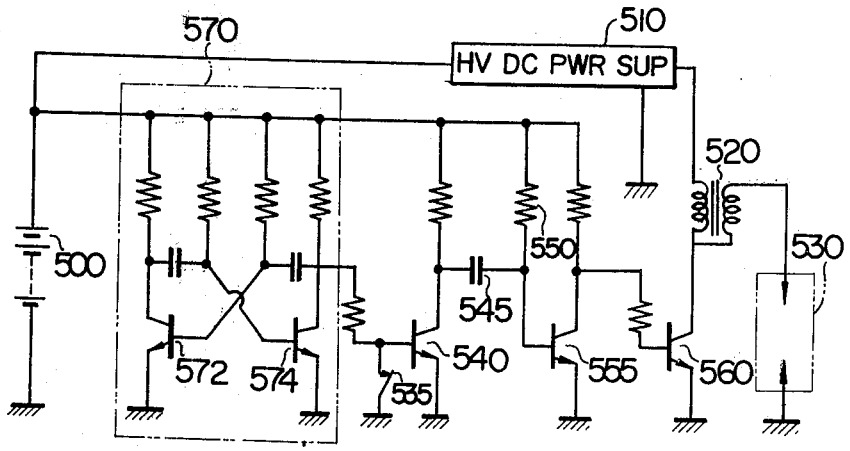
FIG. 5 shows another embodiment of the invention.

FIG. 5 shows another embodiment of the invention. Referring to the figure, numeral 510 designates a high-voltage d-c power source consisting of the voltage step-up circuit 310 and capacitor 325 shown in FIG. 3. It steps up the voltage of battery 500 for impression upon ignition coil 520. Breaker 535 and transistors 540, 555 and 560 operate in the same way as the corresponding parts in the system of FIG. 3. When, the breaker 535 opens, the transistor 560 is triggered to be conductive to produce a spark in a spark plug 530. Concurrently, capacitor 545 is charged with a current flowing into it through resistor 550, thus cutting off the transistor 560.

The circuit of FIG. 5 includes, in addition to the circuit elements in the circuit of FIG. 3, a non-stable multi-vibrator 570 consisting of transistors 572 and 574, with the transistor 574 repeatedly rendered "on" and "off" in a short repetition period. This has the same effects as may be obtained by repeatedly opening and closing the breaker 535. Thus, the transistor 560 is repeatedly rendered "on" and "off". After the lapse of the ignition period the breaker closes, so that non-stable multi-vibrator no longer has any effect upon the transistor 560.

With the system of FIG. 5 the spark waveform of FIG. 4 can be repeated, so that better effects can be obtained. More particularly, the transistor 560 is triggered again to be conductive at an instant slightly after $t_3$, thus producing again the same voltage as what has been produced at instant $t_0$.

Good effects can be obtained by setting the repetition frequency of the non-stable multi-vibrator to about 1 kHz.

I claim:

1. An ignition system for an internal combustion engine comprising:

a first transformer having a primary winding and a secondary winding, an output voltage of said secondary winding being applied to a spark plug in said internal combustion engine;

a first switching means, having a control terminal and connected in series with said primary winding of said first transformer, for closing and opening the series circuit in an on-off operation of said first switching means by a control signal applied upon said control terminal;

a capacitor connected in parallel with said series circuit consisting of said primary winding of said first transformer and said first switching means, said first switching means including a first transistor, the emitter-collector circuit of said first transistor being connected in series with said capacitor and said primary winding of said transformer to form a closed circuit, such that said capacitor discharges through said primary winding upon closing of said series circuit producing a first spark in said spark plug;

a voltage step-up circuit connected to a battery for stepping up the battery voltage, the output of said voltage step-up circuit being supplied to said capacitor for charging said capacitor; and a control circuit means connected to said first switching means for producing and supplying said control signal to said first switching means in synchronism to the rotation of said engine, said control circuit means including a time constant circuit for opening said series circuit after a predetermined time has elapsed less than the duration of said control signal, said primary winding effecting a second spark in said spark plug upon opening said series circuit by means of stored electromagnetic energy in said primary winding during the discharge of said capacitor.

2. An ignition system for an internal combustion engine comprising:

a first transformer having a primary winding and a secondary winding, an output voltage of said secondary winding being applied to a spark plug in said internal combustion engine;

a first switching means, having a control terminal and connected in series with said primary winding of said first transformer, for closing and opening the series circuit in an on-off operation of said first switching means by a control signal applied upon said control terminal;

a capacitor connected in parallel with said series circuit consisting of said primary winding of said first transformer and said first switching means, said first switching means including a first transistor, the emitter-collector circuit of said first transistor being connected in series with said capacitor and said primary winding of said transformer to form a closed circuit;

a voltage step-up circuit connected to a battery for stepping up the battery voltage, the output of said voltage step-up circuit being supplied to said capacitor for charging said capacitor; and a control circuit means connected to said first switching means for producing and supplying said control signal to said first switching means in synchronism to the rotation of said engine, said control circuit means including a time constant circuit for opening said series circuit after a predetermined time less than the duration of said control signal and determined by said time constant circuit has elapsed after the closure of said output circuit of said first switching means, said system further comprising an oscillator, the output of said oscillator being applied to said control circuit means in synchronism to the rotation of said engine, thereby effecting ignition a plurality of times in each ignition cycle.

3. The ignition system for an internal combustion engine according to claim 1, wherein said time constant circuit of said control circuit means includes a second capacitor and a resistor, said first transistor being cut off when the terminal voltage across said second capacitor reaches a predetermined value.

4. The ignition system for an internal combustion engine according to claim 3, wherein said control circuit means includes a second transistor and a third transistor, said second capacitor being connected between the collector of said second transistor and the base of said third transistor, said first transistor being controlled by the collector voltage on said third transistor.

5. An ignition system for an internal combustion engine comprising:

an ignition coil means for supplying an output voltage to a spark plug;

voltage source means for supplying a voltage input to said ignition coil means;

switch circuit means for operatively connecting said voltage source means and said ignition coil means such that said voltage input is supplied to said ignition coil means; and control circuit means for effecting a prolonged spark duration of said spark plug during an ignition cycle by means of both the connection of said voltage source means to said ignition coil means and the storage of electromagnetic energy in said ignition coil means, said control circuit means selectively providing one of a closing and an opening condition of said switch circuit means during an ignition cycle, said closing condition effecting connection of said voltage source means to said ignition coil means producing a first spark in said spark plug, and said opening condition effecting a second spark in said spark plug by means of the stored electromagnetic energy, wherein said control circuit means includes first means for effecting a control signal for said switch circuit means during said ignition cycle in synchronism to the rotation of an internal combustion engine and time-constant circuit means for providing said opening condition during said ignition cycle at a predetermined time less than the duration of said control signal.

6. An ignition system according to claim 5, wherein said ignition coil means includes a primary winding and a secondary winding, said secondary winding supplying said output voltage to said spark plug.

7. An ignition system according to claim 6, wherein said voltage source means includes a voltage source and a capacitor, said capacitor being charged by said voltage source, the charge on said capacitor providing said voltage input to said primary winding.

8. An ignition system for an internal combustion engine comprising:

an ignition coil means for supplying an output voltage to a spark plug, wherein said ignition coil means includes a primary winding and a secondary winding, said secondary winding supplying said output voltage to said spark plug;

voltage source means for supplying a voltage input to said ignition coil means, wherein said voltage source means includes a voltage source and a capacitor, said capacitor being charged by said voltage source, the charge on said capacitor providing said voltage input to said primary winding;

switch circuit means for operatively connecting said voltage source means and said ignition coil means such that said voltage input is supplied to said ignition coil means; and control circuit means for effecting a prolonged spark duration of said spark plug during an ignition cycle by means of both the connection of said voltage source means to said ignition coil means and the storage of electromagnetic energy in said ignition coil means, said control circuit means selectively providing one of a closing and an opening condition of said switch circuit means during an ignition cycle, said closing condition effecting connection of said voltage source means to said ignition coil means producing a first spark plug, and said opening condition effecting a second spark in said spark plug by means of the stored electromagnetic energy, wherein said capacitor discharges through said primary winding upon obtaining said closing condition of said switch circuit means, the discharge of said capacitor through said primary winding inducing a first voltage in said secondary winding, said first voltage providing said first spark in said plug, wherein said capacitor discharging through said primary winding provides the stored electromagnetic energy in said primary winding, said stored electromagnetic energy inducing a second voltage in said secondary winding upon obtaining said opening condition of said switch circuit means, said second voltage providing said second spark in said spark plug, and wherein said control circuit means includes first means for effecting a control signal for said switch circuit means during said ignition cycle in synchronism to the rotation of an internal combustion engine and time-constant circuit means for providing said opening condition during said ignition cycle at a predetermined time less than the duration of said control signal.

9. An ignition system according to claim 8, wherein said predetermined time is determined by said time-constant circuit means in relation to the duration of said closing condition.

10. An ignition system according to claim 9, wherein said switch circuit means includes a first transistor, the emitter-collector circuit of said first transistor being connected in series with said capacitor and said primary winding.

11. An ignition system according to claim 10, wherein said time-constant circuit means includes a second capacitor and a resistor, said first transistor being connected to said time-constant circuit means and being cut-off to provide said opening condition when the voltage across said second capacitor reaches a predetermined value.

12. An ignition system according to claim 11, wherein said control circuit means further includes a second transistor and a third transistor, said second capacitor being connected between the collector of said second transistor and the base of said third transistor, said first transistor being controlled by the collector voltage on said third transistor.

13. An ignition system according to claim 12, wherein said first means for obtaining said ignition cycle includes a breaker means, said breaker means being opened at the start of said ignition cycle, and said breaker means being operatively connected to said second and third transistors to trigger said first transistor into said closing condition at said start of said ignition cycle.

14. An ignition system according to claim 7, wherein said voltage source includes a battery and a voltage step-up circuit.

15. An ignition system according to claim 14, wherein said voltage step-up circuit includes a step-up transformer, an oscillator circuit for providing a signal to said step-up transformer and a rectifying circuit for rectifying the induced voltage from said step-up transformer.

16. An ignition system according to claim 9, wherein said control circuit means further includes a non-stable multi-vibrator circuit means for repeatedly providing said closing and opening conditions of said switch circuit means during said ignition cycle.

17. An ignition system according to claim 9, wherein the duration of said closing condition is about 0.5 milliseconds.

18. An ignition system according to claim 9, wherein said ignition cycle is maintained from about 1 to 2 milliseconds.

19. An ignition system for an internal combustion engine comprising:

an ignition coil means for supplying an output voltage to a spark plug;

voltage source means for supplying a voltage input to said ignition coil means;

switch circuit means for operatively connecting said voltage source means and said ignition coil means such that said voltage input is supplied to said ignition coil means; and control circuit means for effecting a prolonged spark duration of said spark plug during an ignition cycle by means of both the connection of said voltage source to said ignition coil means and the storage of electromagnetic energy in said ignition coil means, said control circuit means selectively providing one of a closing and an opening condition of said switch circuit means during an ignition cycle, said closing condition effecting connection of said voltage source means to said ignition coil means producing a first spark in said spark plug, and said opening condition effecting a second spark in said spark plug by means of the stored electromagnetic energy, wherein said control circuit means further includes a non-stable multi-vibrator circuit means for repeatedly providing said closing and opening conditions of said switch circuit means during said ignition cycle, and wherein said control circuit means includes first means for effecting a control signal for said switch circuit means during said ignition cycle in synchronism to the rotation of an internal combustion engine and time-constant circuit means for providing said opening condition during said ignition cycle at a predetermined time less than the duration of said control signal.

20. An ignition system according to claim 5, wherein said spark duration is maintained from about 1 to 2 milliseconds.

21. An ignition system according to claim 5, wherein said predetermined time determined by the time constant of said time-constant circuit means is about 0.5 milliseconds.

22. An ignition system according to claim 5, wherein said switch circuit means includes a first transistor, the emitter-collector circuit of said first transistor being connected in series with said capacitor and said primary winding.

23. An ignition system according to claim 22, wherein said time-constant circuit means includes a second capacitor and a resistor, said first transistor being connected to said time-constant circuit means and being cut-off to provide said opening condition when the voltage across said second capacitor reaches a predetermined value.

24. An ignition system according to claim 23, wherein said control circuit means further includes a second transistor and a third transistor, said second capacitor being connected between the collector of said second transistor and the base of said third transistor, said first transistor being controlled by the collector voltage on said third transistor.

25. An ignition system according to claim 24, wherein said first means for obtaining said ignition cycle includes a breaker means, said breaker means being opened at the start of said ignition cycle, and said breaker means being operatively connected to said second and third transistors to trigger said first transistor into said closing condition at said start of said ignition cycle.

26. An ignition system for an internal combustion engine comprising:

an ignition coil means for supplying an output voltage to a spark plug;

voltage source means for supplying a voltage input to said ignition coil means;

switch circuit means for operatively connecting said voltage source means and said ignition coil means such that said voltage input is supplied to said ignition coil means, said switch circuit means including a first transistor; and control circuit means for effecting a prolonged spark duration of said spark plug during an ignition cycle by means of both the connection of said voltage source means to said ignition coil means and the storage of electromagnetic energy in said ignition coil means, wherein said control circuit means comprises a second transistor connected to said first transistor for maintaining said first transistor non-conductive when said second transistor is conductive, a third transistor operatively connected to said second transistor for controlling said second transistor, time-constant circuit means connected between said second and third transistors for changing the conductive state of said second transistor at a predetermined time determined by the time constant of said time-constant circuit, and first means for providing a control signal during said ignition cycle in synchronism to the rotation of an internal combustion engine, said control signal being applied to said third transistor to place said second transistor in the non-conductive state such that said first transistor becomes conductive, and wherein said time-constant circuit means changes said second transistor to the conductive state after said predetermined time, thereby placing said first transistor in the non-conductive state.

27. An ignition system according to claim 26, wherein said ignition coil means includes a primary winding and a secondary winding, said secondary winding supplying said output voltage to said spark plug.

28. An ignition system according to claim 27, wherein said voltage source means includes a voltage source and a capacitor, said capacitor being charged by said voltage source, the charge on said capacitor providing said voltage input to said primary winding.

29. An ignition system according to claim 26, wherein said time-constant circuit means includes a capacitor and a resistor, said capacitor being connected between the collector of said third transistor and the base of said second transistor such that said second transistor is placed in the conductive state when the voltage across said capacitor reaches a predetermined value, thereby placing said first transistor in the non-conductive state.

30. An ignition system according to claim 26, wherein said predetermined time determined by said time constant of said time-constant circuit means is about 0.5 milliseconds.

31. An ignition system according to claim 26, wherein said spark duration is maintained from about 1 to 2 milliseconds.

* * * * *